US006981328B2

(12) United States Patent
Solum

(10) Patent No.: US 6,981,328 B2
(45) Date of Patent: Jan. 3, 2006

(54) COMPASS AND ELLIPSOGRAPH FOR PERSONS WITH MANUAL LIMITATIONS

(76) Inventor: Roy O. Solum, 4333 Plum St., Boise, ID (US) 83703

( * ) Notice: Subject to any disclaimer, the term of this patent is extended or adjusted under 35 U.S.C. 154(b) by 14 days.

(21) Appl. No.: 10/833,837

(22) Filed: Apr. 27, 2004

(65) Prior Publication Data

US 2004/0226180 A1 Nov. 18, 2004

Related U.S. Application Data

(60) Provisional application No. 60/469,888, filed on May 13, 2003.

(51) Int. Cl.
*B43L 9/04* (2006.01)

(52) U.S. Cl. ..... 33/27.02; 33/27.03; 33/27.031

(58) Field of Classification Search ..... 33/27.02, 33/27.01, 27.03, 27.031, 27.032, 27.04, 27.06, 33/27.07, 558.01, 558.04, 558.4
See application file for complete search history.

(56) References Cited

U.S. PATENT DOCUMENTS 1,263,182 A * 4/1918 Wolthausen ..... 33/27.02
1,316,642 A * 9/1919 Perkins et al. ..... 33/27.04
1,402,961 A 1/1922 Ratcliff
2,498,798 A 2/1950 Edwards
2,547,320 A * 4/1951 Hedley ..... 33/27.03
2,607,991 A 8/1952 Fleetwood
2,690,013 A 9/1954 MacGuire
3,068,577 A * 12/1962 Wilson ..... 33/27.02
3,111,761 A * 11/1963 McAlister, Jr. ..... 33/27.03
3,315,361 A * 4/1967 Mutter ..... 33/27.03
3,656,237 A 4/1972 Killgrove
3,787,992 A 1/1974 Leonhardt
5,203,091 A * 4/1993 Al-Farsy ..... 33/558.3
5,473,940 A * 12/1995 Parker ..... 33/558.01
5,542,185 A * 8/1996 Boda ..... 33/27.02

* cited by examiner

*Primary Examiner*—Christopher W. Fulton
(74) *Attorney, Agent, or Firm*—Derek H. Maughan; Dykas, Shaver & Nipper

(57) ABSTRACT

A safe, stable compass for making circles and ellipses, having a stable rotating platform with a variably adjustable arm that allows the device to be self-supporting upon a surface and to be easily rotated in any one of a variety of directions around a single rotating point. The invention allows persons of limited manual dexterity to apply force in one location and then to rotate the entire device around this one point.

16 Claims, 4 Drawing Sheets

COMPASS AND ELLIPSOGRAPH FOR PERSONS WITH MANUAL LIMITATIONS

PRIORITY

This application claims the priority date of the provisional application entitled All In One Compass filed by Roy O. Solum on May 13, 2003, with application Ser. No. 60/469,888, the disclosure of which is incorporated herein by reference.

BACKGROUND OF THE INVENTION

1. Field of the Invention

The present invention generally relates to tools for making circles, and more particularly relates to compasses and ellipsographs for persons with manual limitations.

2. Background Information

In order to form circles or ellipses, a variety of tools have been developed. One of the most common types of tools is a pointed compass, which includes a first arm that extends from a point to a pivot. At this pivot, the first arm is connected to a second arm, which is typically connected to a scribing device such as a pencil or other marking device. These tools are typically utilized by placing the point at a pre-selected location, adjusting the scribing device a desired distance from the central pivot point, and twisting the scribing device about the central point so as to establish a circular shape. Ellipses can also be formed by bringing the scribing portion closer to the central point as the device is turned.

These types of devices have several significant shortcomings. As a first matter, these devices typically require a certain level of manual dexterity in order to twist the compass around the pivot point. This level of manual dexterity is simply not available to many individuals who, because of age, physical or mental condition are simply not able to steadily twist the device in a desired position and orientation. As a result, these tools are oftentimes not effective for forming a circle or ellipse because of the inherent instability of the compass itself. As a second matter, many times these devices are made of metal or plastic and include a sharp point, which can provide a danger to the user as well as to other persons.

Other types of circle forming devices have also been developed, but these devices typically include a base that is placed upon or around a surface to be marked and that is held in a fixed position while a marking devices is rotated around a portion of the fixed base. These devices are typically bulky and expensive and thus not well suited for portable use or for access by a wide variety of persons.

Therefore, what is needed is a compass for making and marking circles and ellipses that provides increased stability and safety, can be utilized by persons with manual limitations, and which can be easily transported from one location to another. What is also needed is a device that performs all of the above features and which is also cost effective to produce and which can thus be made commercially available to a wide variety of persons.

Accordingly, it is an object of the present invention to provide a safe, stable compass to persons of limited manual capability. It is a further object of the invention to provide a safe stable compass that can be easily transported from one location to another and can be manufactured in a cost effective manner so as to provide for access to said product by a variety of individuals.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a safe, stable compass for making circles and ellipses. The present invention is specifically adapted and configured so as to provide a stable rotating platform with a variably adjustable arm that allows the device to be self-supporting upon a surface and to be easily rotated in any one of a variety of directions around a single rotating point. The invention allows persons of limited manual dexterity to apply force in one location and then to rotate the entire device around this one point. The use of a large stable base with an arm that is selectively pivotally connected thereto allows the device to form circles having various desired configurations.

The connection between the arm and the base allows for selective pivotal orientation and allows the arm to be folded back on to the base of the device so as to be easily transported from one location to another. In the preferred embodiment, the device is also made from a plastic material. The rotating point is covered and configured to allow the device to be made in a manner that is less expensive than other devices that are found in the prior art. In addition, in the preferred embodiment, the arm of the device is adapted to hold either a marking or a cutting device, thus allowing the present invention to not only be able to mark circles, but also to be able to cut circles, ellipses, and other desired shapes.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
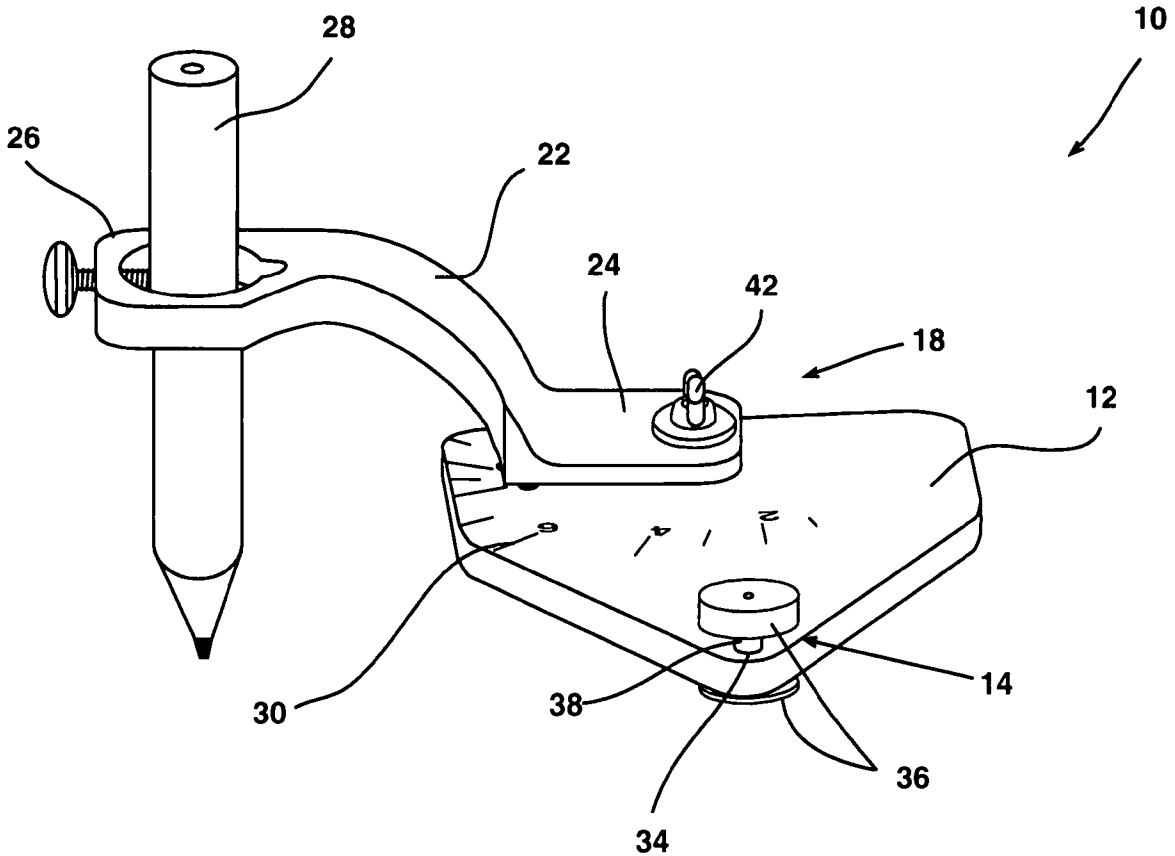
FIG. 1 is a perspective view of a first preferred embodiment of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
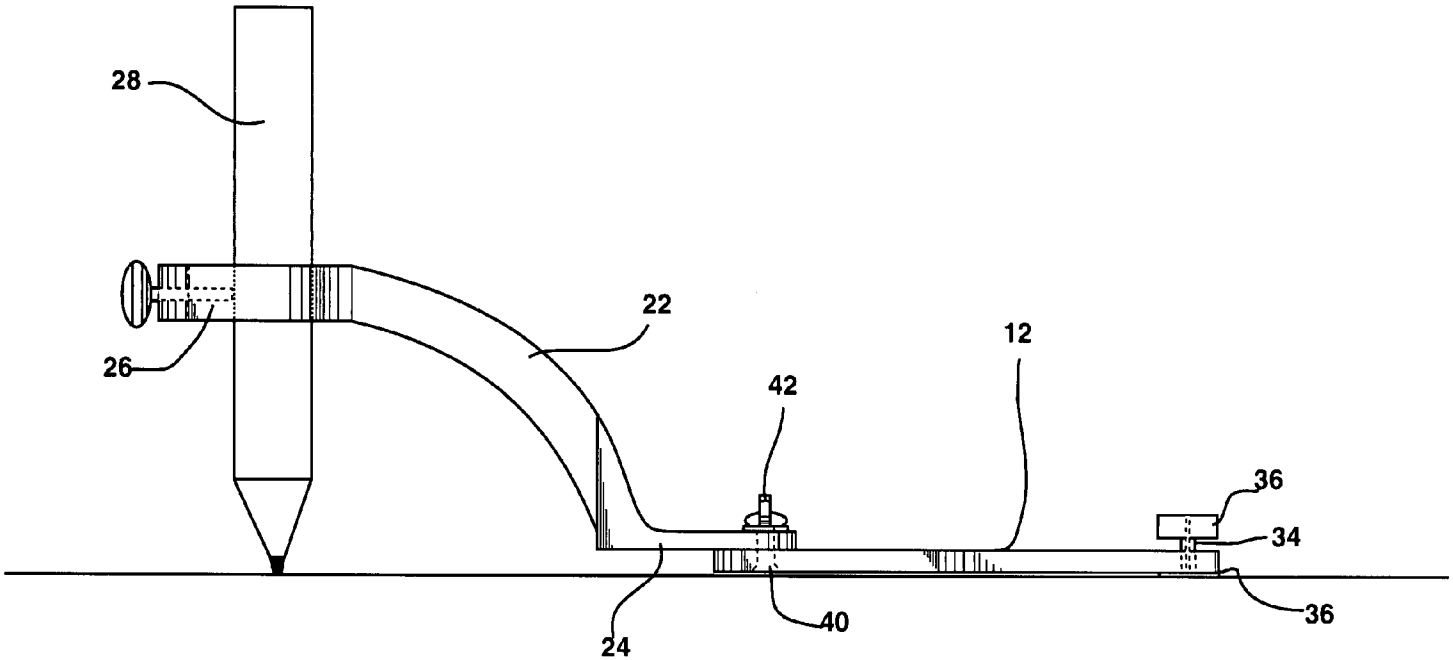
FIG. 2 is a plan side view of the embodiment of the invention shown in FIG. 1.
Figure 3:
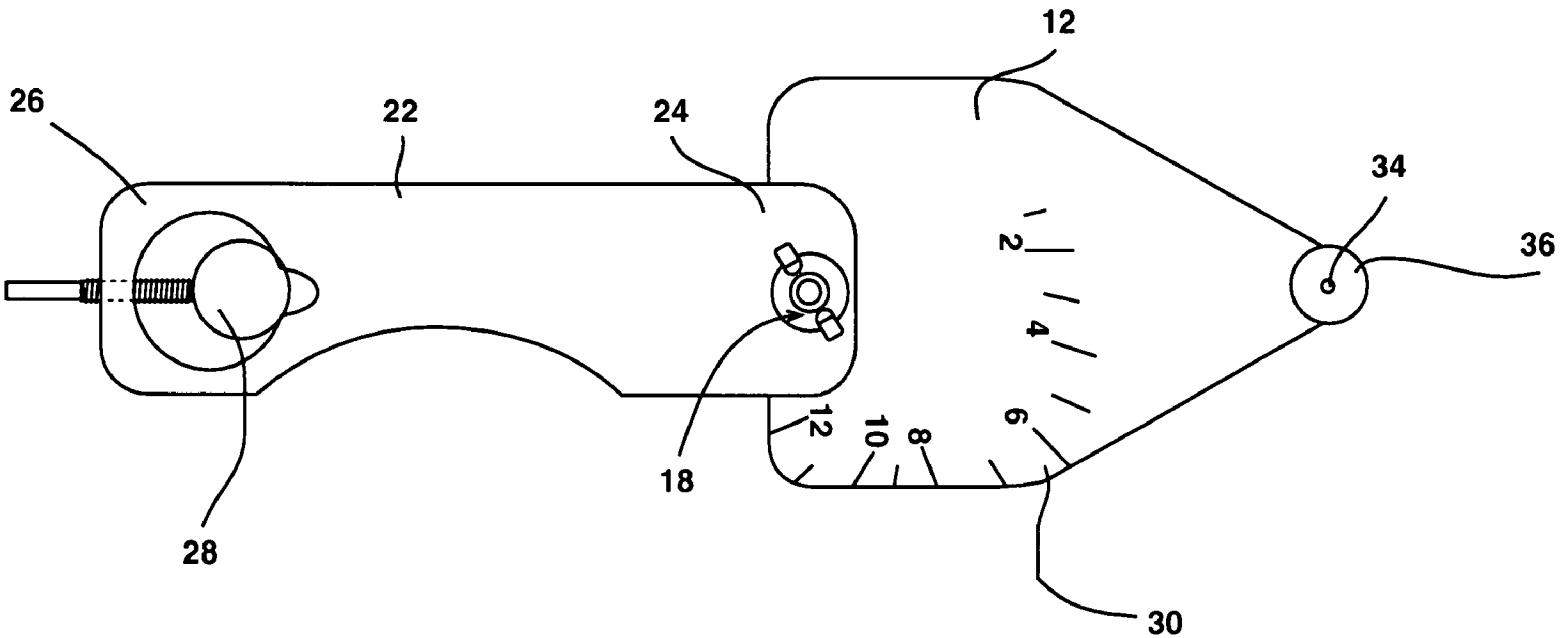
FIG. 3 is a top plan view of the embodiment of the invention shown in FIG. 1.
Figure 4:
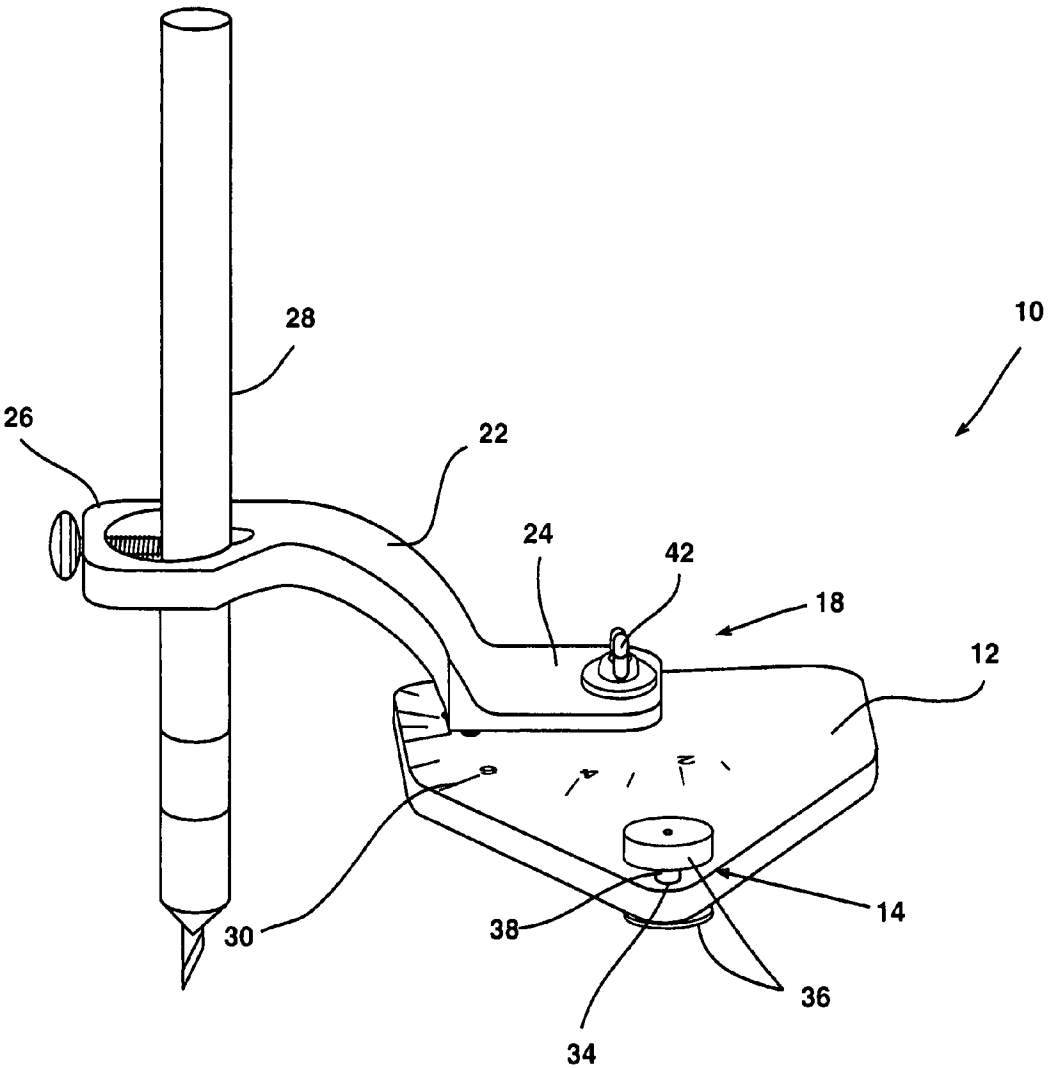
FIG. 4 is a perspective view of a second embodiment of the invention.

As shown in FIGS. 1–3, the present invention is a compass that is shaped and designed to allow a party to draw circles and elliptical figures having a desired shape and configuration. The compass of the present invention provides several advantages over the prior art in that it provides a party with a more definite and stable base from which the circle can be drawn. This allows for increased ease of use without the dangers, instabilities, and marring of underlying surface material that exists with many of the prior art devices. The present invention in its preferred embodiment also lacks any sharp protruding portions that are seen in the prior art and thus is a comparably safer device that can be utilized. Furthermore, the present invention also provides a compass that provides all of the aforementioned advantages and that can be easily stored for later use, as well as a compass that can be easily transported from one location to another. The simple design of the present invention also lends the invention to increased ability of the device to be utilized by a variety of individuals with various limitations to their manual dexterity. The design and features of the present invention also allow the device to be manufactured by simple manufacturing techniques and thus to be available to a wide variety of persons at a relatively low cost.

Referring first to FIG. 1 of the present invention, a first embodiment of the present invention is shown. The invention is a compass 10 having a base plate 12, with marking indicia 30, having a body. The body of the base plate 12 defines a first pointer 14 and extends to an arm connecting portion 16. In some embodiments of the invention, the first pointer 14 may be a portion of the base that is simply shaped as a pointer and is utilized to maintain and hold the device 10 in a desired position and orientation. In other embodiments, the first pointer 14 may be a device such as a finger or a writing instrument such as a pen, pencil, marker or other device that is configured to pass through an aperture 34 within the base plate 12 and provide a post about which the base plate 12 will rotate. In the preferred embodiment, the pointer 14 is a small rod 38 having rubber circles 36 on each end. This rod 38 is configured to fit within an aperture 34 in the base plate 12 and to allow the base plate 12 to rotate freely around the post 38 when pressure is applied to the rubber circles 36 so as to hold the post 38 in a desired location.

The base plate 12 is selectively adjustably connected to an arm 22 through an adjustable connection device 18. The adjustable connection device 18 allows the orientation of the arm 22 in relation to the base plate 12 to be selectively varied and locked, thus allowing the diameters of the various circles and the radiuses of the various arcs to be varied. In the preferred embodiment, the adjustable connection device 18 is a nut and bolt combination (most preferably a wing nut and bolt combination). This configuration allows for nearly infinite adjustment of the arm in relation to the base plate 12. While this type of connection device 18 is shown as the preferred embodiment, it is to be distinctly understood that the invention is not limited thereto but may be variously embodied to bring about the desired ends of a connector that allows the position of the arm 22 to be adjusted and locked in a desired position and orientation. This includes various devices including pawls, ratchets, and gaps as long as these devices allow the position and orientation of the arm 22 to be selectively turned and locked in relation to the position and orientation of the base plate 12.

The arm 22 of the present of the invention is selectively rotatably positioned upon the base plate 12 through the adjustable connection device 18. This allows the arm 22 to be positioned and held in any one of a variety of preselected positions. The arm 22 has a first end 24 designed for placement against the base plate 12 through the selectively adjustable connection device 18 and extends along a length to a second end 26. In the preferred embodiment, the first end of the arm 24 has a hole configured to receive a bolt 40, which extends through the base plate 12 and the first end of the arm 24 and connects with a compatibly configured nut 42. The arm 24 extends along a length to a second end 26, which is configured to receive and hold a scribing device 28 therein. The scribing device 28 may be either a marking device or a cutting device, depending upon the necessities of the user and the material with which the device is being utilized. In the preferred embodiment, the second end of the arm 26 provides an adjustably sized aperture, which allows scribing devices 28 of various widths and dimensions to be utilized in the various embodiments of the invention. Among the items that may be utilized as scribing devices 28 in the present embodiment of the invention are pens, pencils, markers, cutting razors, and other similar items. The aforementioned list is intended to be merely illustrative and in no way should be deemed as an exclusive list of accessories that may be utilized as scribing devices within the present invention.

In use, a party utilizing the device 10 places a scribing device 28 within the second end 26 of said arm and adjusts the position of the scribing device 28 within the second end of the arm 22 so that the desired portion of the scribing device 28 is in contact with a portion of a surface that is to be scribed. The first pointer 14 is placed in a desired center location and the arm 22 is moved into a desired position. In order to assist a user of the device, various positions for the arm 22 are marked along the base plate 12. These positions approximate the diameters of the circles that can be drawn utilizing the device 10. The base plate 12 and the arm 22 are thereafter rotated about the first pointer 14 so as to cause the scribing device 28 to scribe an arc of a desired size and shape about the first pointer 14. This system is significantly more stable than other devices that exist in the prior art and allow persons with limited manual dexterity to be able to utilize the present invention.

In addition to the features shown in the preferred embodiment, it is to be distinctly understood that a variety of other features may also be utilized. These features include embodiments where the first pointer 14 is simply a point positioned upon the base plate 12, rather than the rotating type embodiments that exist in the preferred embodiment. In addition to these features, it is to be distinctly understood that a variety of other types of pieces, handles, and accessibility features may be added to the existing invention all without departing from the scope of the invention as described in the following claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A compass configured to allow a party with reduced manual dexterity to draw circles and elliptical figures of a desired shape and configuration, said compass comprising:

a base plate having a generally flat wide body, said generally flat wide body configured to allow a person with limited manual dexterity to grasp and move said body, said body defining a first pointer and an arm connecting portion;

a selectively adjustable connection device, said selectively adjustable connection device configured to connect the base plate of the device to an upwardly extending arcuately-shaped arm in any one of a variety of preselected positions;

said arcuately-shaped arm having a first end desired for placement against said base plate through said selectively adjustable connection device and extending along an uprising arc shaped length to a second end, said second end configured to receive and hold a portion of a scribing device therein;

whereby a party places a scribing device within said second end of said arcuately-shaped arm, and adjusts said scribing device so that said a portion of said scribing device is in contact with a portion of a surface, said first pointer is placed in a desired center location and said arcuately-shaped arm is moved into one of said selectively desired positions, said base plate and said arcuately-shaped arm are thereafter rotated about said first pointer so as to cause said scribing device to scribe an arc of a desired size and shape about said center location.

2. The compass of claim 1 wherein said base plate further comprises indicia indicating the location in which the arcuately-shaped arm must be positioned so as to create circles of various approximate diameters.

3. The compass of claim 1 wherein said first pointer is rotatably positioned within said base plate.

4. The compass of claim 1 wherein said selectively adjustable connection device comprises a device which allows a user to selectively turn and lock said arcuately-shaped arm in any one of a variety of preselected positions and orientations.

5. The compass of claim 1 wherein said arcuately-shaped arm has a length greater than the length of said base plate.

6. The compass of claim 1 wherein said second end of said arcuately-shaped arm comprises an implement holder said implement holder configured to hold a scribing device therein.

7. The compass of claim 1 wherein said scribing device is a writing instrument.

8. The compass of claim 1 wherein said scribing device is a cutting device.

9. A compass configured to allow a party with reduced manual dexterity to draw circles and elliptical figures of a desired shape and configuration, said compass comprising:

a base plate having a generally wide flat body, said generally wide flat body configured to allow a person with limited manual dexterity to grasp and move said body, said body defining a pointer aperture said pointer aperture configured to receive a first pointer therein, said base plate further comprising an arm connecting portion;

a selectively adjustable connection device, said selectively adjustable connection device connecting the base plate of the device to an upwardly extending arcuately-shaped arm of the device in any one of a variety of preselected positions; and said arcuately-shaped arm having a first end desired for placement against said base plate through said selectively adjustable connection device and extending along a length to a second end, said second end configured to receive and hold a portion of a scribing device therein;

whereby a party places a scribing device within said second end of said arcuately-shaped arm, and adjusts said scribing device so that said a portion of said scribing device is in contact with a portion of a surface, said first pointer is inserted through said pointer aperture and said arcuately-shaped arm is moved into one of said selectively desired positions, said base plate and said arcuately-shaped arm are thereafter rotated about said first pointer so as to cause said scribing device to scribe an arc of a desired size and shape about said central point.

10. The compass of claim 9 wherein said base plate further comprises indicia indicating the location in which the arcuately-shaped arm must be connected so as to create circles of various approximate diameters.

11. The compass of claim 9 wherein said first pointer is a rubber tipped pointer rotatably positioned within said base plate.

12. The compass of claim 9 wherein said selectively adjustable connection device comprises a device which allows a user to selectively turn and lock said arcuately-shaped arm in any one of a variety of preselected positions and orientations.

13. The compass of claim 9 wherein said arcuately-shaped arm has a length greater than the length of said base plate.

14. The compass of claim 9 wherein said second end of said arcuately-shaped arm comprises an implement holder said implement holder configured to hold a scribing device therein.

15. The compass of claim 9 wherein said scribing device is a writing instrument.

16. The compass of claim 9 wherein said scribing device is a cutting device.

* * * * *